United States Patent [19]

Scanlon

[11] 4,338,586

[45] Jul. 6, 1982

[54] CIRCUIT PROTECTOR HAVING A SLIDABLE LATCH

[75] Inventor: William F. Scanlon, New Hope, Pa.

[73] Assignee: Heinemann Electric Company, Trenton, N.J.

[21] Appl. No.: 183,959

[22] Filed: Sep. 3, 1980

[51] Int. Cl.[3] ..... H01H 71/16

[52] U.S. Cl. ..... 337/74; 337/64; 337/70

[58] Field of Search ..... 337/74, 70, 71, 72, 337/55, 66, 60, 59, 64

[56] References Cited

U.S. PATENT DOCUMENTS 4,148,002 4/1979 Krasser ..... 337/74

*Primary Examiner*—Harold Broome

*Attorney, Agent, or Firm*—Joseph G. Denny, III; Peter J. Patane

[57] ABSTRACT

A circuit protector comprising a case and a rocker or handle movable between "on" and "off" positions. A spring has one leg biased against the case and the other leg biased against the rocker for biasing the rocker to the "off" position. Within the case is a stationary contact and a movable contact carried by a movable contact blade. The rocker includes an extension which carries a pivotal latch lever and a slidable latch. The latch lever has a detent for restraining movement of the slidable latch. Further, the slidable latch includes a cam stop engaging a raised portion of the movable contact blade to keep the contacts engaged. A bimetal, on predetermined overload heating, engages the latch lever and pivots it away from the slidable latch, whereupon the detent is moved out of engagement with the slidable latch permitting the slidable latch to move upwardly under pressure of the movable contact blade and also permitting the rocker to be pivoted by the spring to the contacts "off" position.

4 Claims, 11 Drawing Figures

FIG. 1
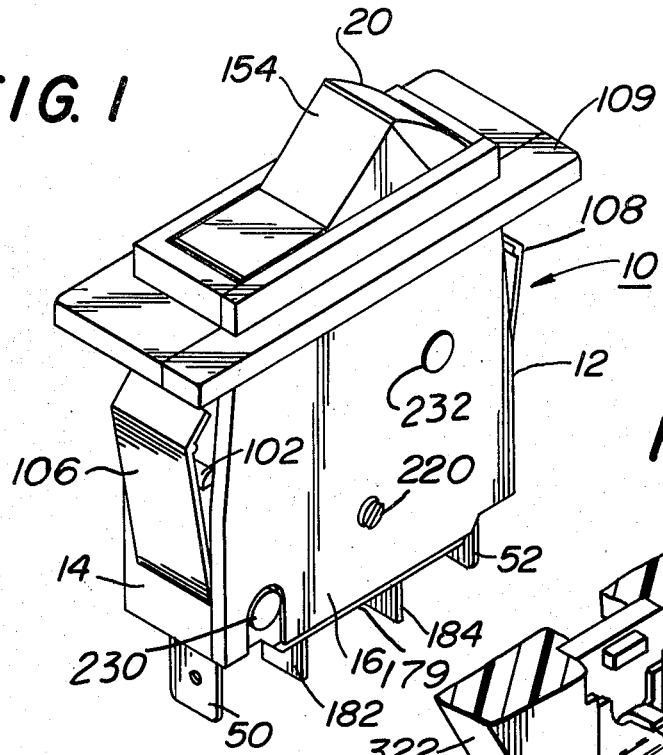
FIG. 11
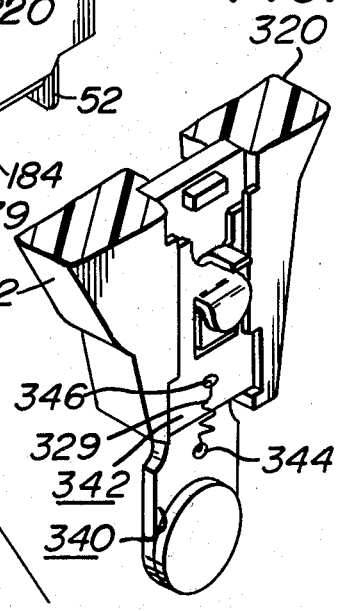
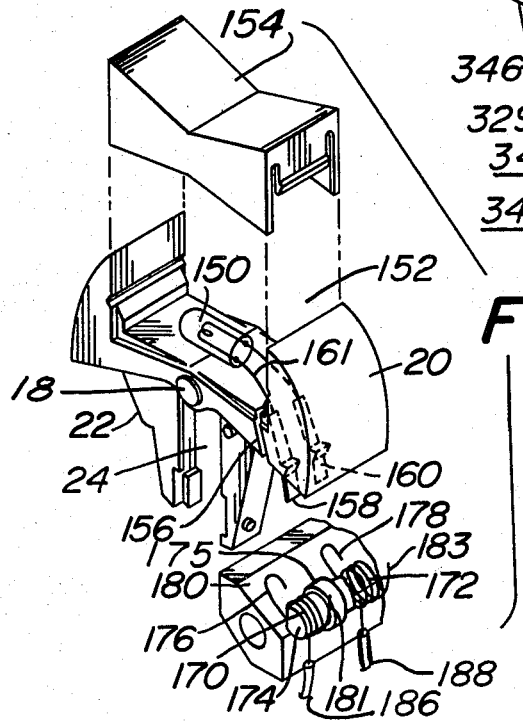
FIG. 10

FIG. 7
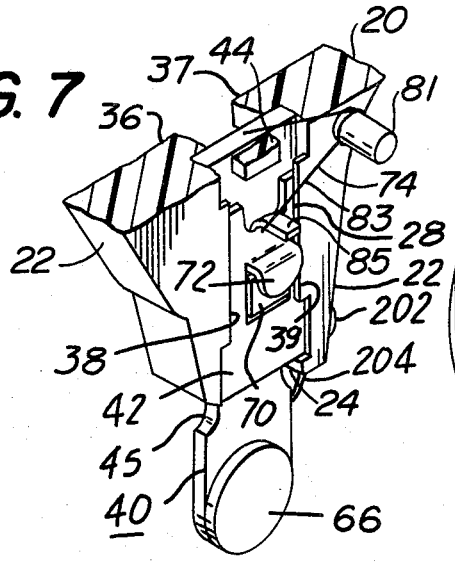
FIG. 9
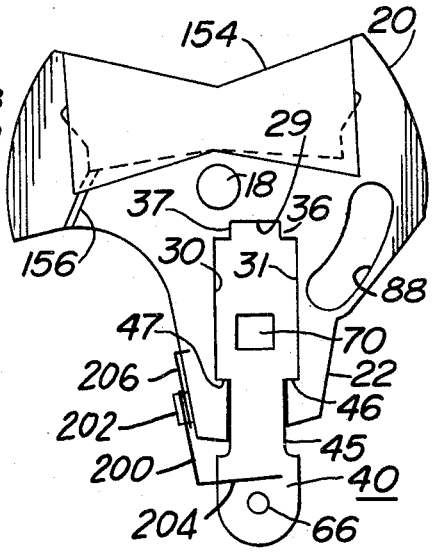
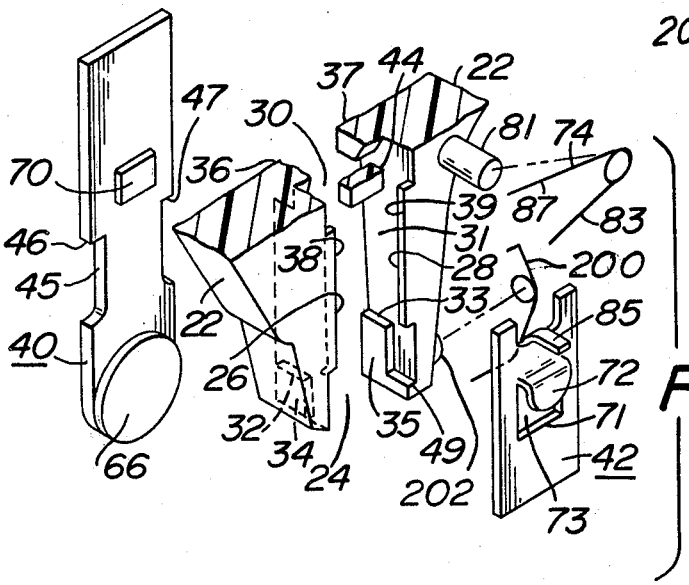
FIG. 8

CIRCUIT PROTECTOR HAVING A SLIDABLE LATCH

BACKGROUND OF THE INVENTION

This invention relates to low amperage and low voltage electrical circuit protectors and electrical switches. Such circuit protectors and electrical switches are used, for example, to protect from overload or to control domestic appliances, although they are not limited to these uses.

Typically these circuit protectors and switches are rated to carry currents up to 20 amperes at 250 volts AC (50/60 HZ) or 32 volts DC.

A circuit protector and switch of this type is disclosed in U.S. Pat. No. 4,148,002. In Pat. No. 4,148,002 a circuit protector is disclosed having a rocker 5 and a release lever 8 pivotally connected thereto by a pin 7. In the present invention a latching arrangement is provided which does not require any such pin connection.

BRIEF SUMMARY OF THE INVENTION

It is an object of this invention to provide a circuit protector or switch without any pin connections in the mechanism so as to facilitate assembly.

Another object is to provide a circuit protector formed by a minimum of parts.

In this invention the latching of the movable contact blade is achieved by two members, a slidable latch and a latch lever which are carried in a slot formed on an extension of the rocker. A spring carried by the extension biases the slidable latch downwardly toward the movable contact blade, but the walls of the extension defining the slot limit downward movement of the slidable latch.

The latch lever is biased by another spring toward the slidable latch and toward a bimetal for sensing overloads.

The slidable latch includes a stop cam which bears against the movable contact blade to close the contacts. The latch lever has a detent which engages a part of the slidable latch to restrain movement of the slidable latch under the bias of the movable contact spring.

Upon sufficient heating of the bimetal, it flexes sufficiently to engage and pivot the latch lever until it releases the slidable latch whereupon the movable contact is released resulting in an opening of the contacts.

The foregoing and other objects of the invention, the principles of the invention and the best modes in which I have contemplated applying such principles will more fully appear from the following description and accompanying drawings in illustration thereof.

BRIEF DESCRIPTION OF THE VIEWS

In the drawings,

FIG. 1 is a top perspective view of a circuit protector embodying this invention;

FIG. 7 is a partial perspective view of the extension of the rocker, the latch lever, the slidable latch and the associated springs;

FIG. 8 is an exploded view of the parts shown in FIG. 7;

FIG. 9 is a back view, relative to FIGS. 2, 3, and 4, of the rocker and latch lever, and the spring for the latch lever;

FIG. 10 is an exploded top perspective view of the rocker, a portion of the base, the lamp within the rocker, and the electrical connection for the lamp; and FIG. 11 is a view similar to FIG. 7 but showing a modification of this invention.

DETAILED DESCRIPTION

Figure 2:
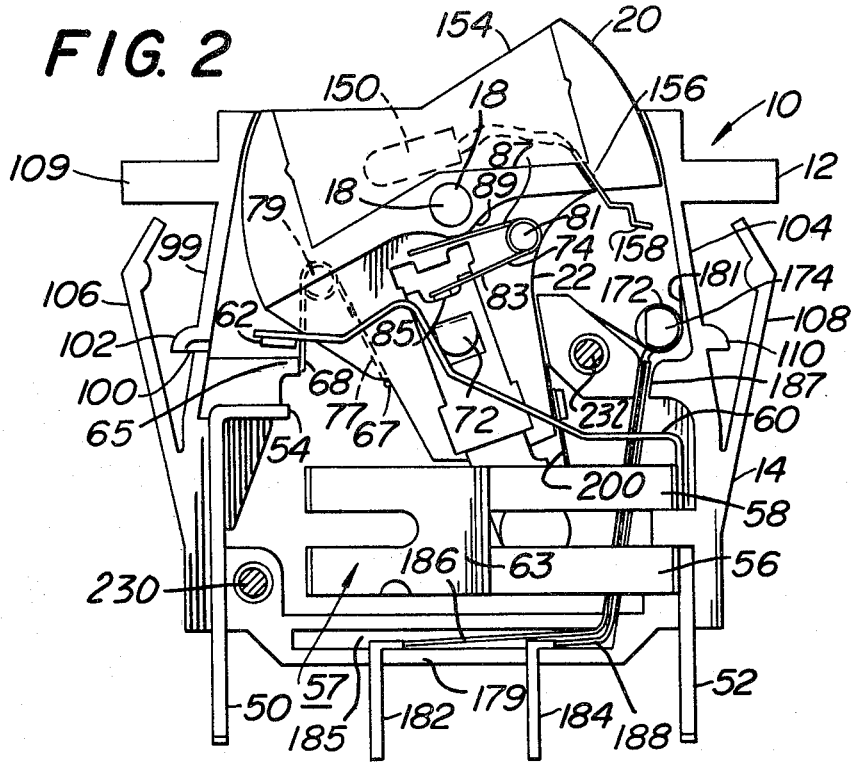
FIG. 2 is a slide elevation of the circuit protector shown in FIG. 1 but with the cover removed and the contacts in the open position.

Referring to the drawings, FIG. 1 illustrates a circuit protector 10 comprising a case 12 formed by a base 14 and a cover 16.

FIG. 2 is an elevation view with the cover 16 removed so as to show the internal parts, the protector 10 being shown in the contacts open or "off" position. Pivotally mounted to the base 14 and cover 16 is a rocker or handle 20 having projections or bosses 18 (FIG. 5) extending from opposite sides of the rocker and pivotally received in suitable openings formed in the base 14 and cover 16.

The rocker 20 includes an integral extension 22 depending, as shown. The extension 22 is formed with a slot 24 (FIG. 8) receiving a pivotal latch lever 40 and a slidable latch 42. The slot 24 is open at its lower end but is closed at its upper end by the top wall 29 (FIG. 5) and is formed at its sides by opposed longitudinal walls 26 and 28 (FIG. 8).

Referring to FIGS. 7 and 8, the opposed walls 26 and 28 are formed with recesses 30 and 31 bounded at the bottom by shoulders 32 and 33 formed by projections 34 and 35. The opposed walls 26 and 28 also include projections 36 and 37, at the top and back and ribs 38 and 39 at the front, as shown in FIG. 8.

Figure 5:
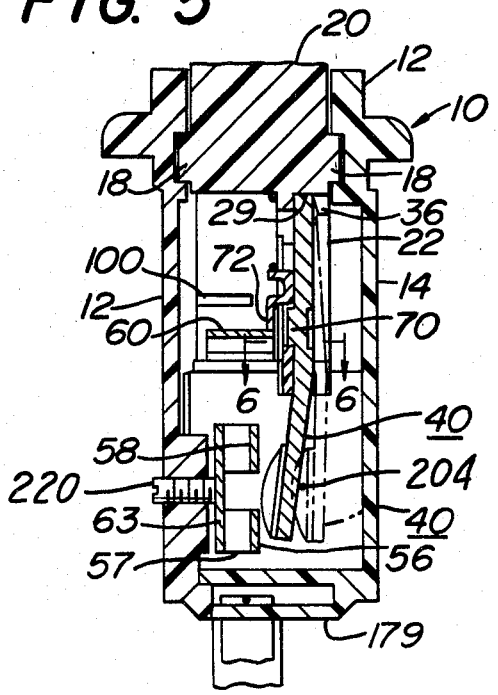
FIG. 5 is a cross-sectional view taken along the line 5—5 in FIG. 3.
Figure 6:
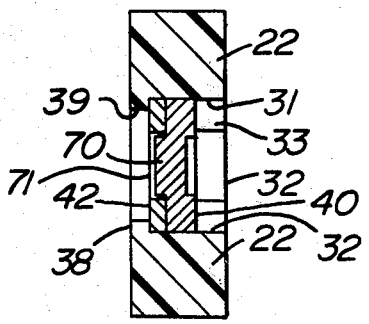
FIG. 6 is a partial cross-sectional view taken along the line 6—6 in FIG. 5.

The latch lever 40 is placed against the top wall 29 so as to rest between the projections 36 and 37 and a depending lip 44 which hangs down from the top wall 29. The projections 36 and 37 are sloped, as shown in FIGS. 5 and 8, and spaced apart sufficiently from the depending lip 44 to permit the latch lever 40 to pivot back and forth between the solid line and dot-dash line positions shown in FIG. 5, as hereinafter further described. The latch lever 40 has a necked portion 45 defining shoulders 46 and 47 which limit downward movement of the latch lever 40 by engagement with the shoulders 32 and 33 while permitting the latch lever 40 to pivot back and forth.

The latch slide 42 is placed in front of the latch lever 40 and between the opposed walls 26 and 28, as shown in FIGS. 7 and 8. The side margins of the latch slide 42 are received in the recesses 30 and 31 against the ribs 38 and 39 so that the latch lever 40 and latch slide 42 are trapped in the slot 24 although the latch lever 40 may pivot back and forth and the latch slide 42 may move up and down to limited extents. The recesses 30 and 31 include portions in front of the projections 34 and 35 (FIG. 8) into which fits the lower portion of the latch slide 42. The portion of the recess 31 in front of the projection 35 terminates in a stop 49 for limiting downward movement of the latch slide 42. Forward movement of the latch slide 42 is limited by the ribs 38 and 39 formed in the opposed walls 26 and 28 which define, in part, the recesses 30 and 31. The ribs 38 and 39 terminate above the projections 34 and 35 so that a space exists between the top of the projections 34 and 35 and the lower ends of the ribs 38 and 39 to permit the latch slide 42 to be inserted into the recesses 30 and 31 behind the ribs 38 and 39.

The latch slide 42 is inserted (from the front and bottom as viewed in FIGS. 7 and 8) by tilting it and sliding it up toward the top of the slot 24 and with its margins in the recesses 30 and 31. The latch slide 42 is manually held against the ribs 38 and 39 while the latch lever 40 is inserted (from the bottom and back, as viewed in FIGS. 7 and 8) between the projections 36 and 37 and the previously inserted latch slide 42 and between the opposed walls 26 and 28 and in abutment with the top wall 29.

The latch lever 40 is biased toward the latch slide 42 and also biased toward the bimetal 57 by a torsion spring 200 carried on a boss 202 formed on the left side, as viewed in FIG. 9, of the rocker extension 22. The spring 200 has one leg 204 biased against the lower portion of the latch lever 40 and the upper leg 206 biased on an edge margin of the extension 22, as shown in FIG. 9, for this purpose.

The base 14 carries a line terminal 50 and a load terminal 52. The upper portion of the line terminal 50 is bent at a right angle to the major portion of the terminal 50 to form a stationary contact 54.

Secured to the load terminal 52 is one leg 56 of U-shaped bimetal 57 which is in turn connected by its other leg 58 to a movable contact blade 60 (of resilient spring material) having a movable contact 62 at one end engageable with the stationary contact 54, as shown in FIG. 2. The legs 56 and 58 are connected together, at base 63, the legs 56 and 58 being folded back toward the load terminal 52 to provide for a longer bimetal within the allotted space within the case 12.

The movable blade 60 includes a raised hump or projection 80, intermediate its ends but adjacent the free end to which the contact 62 is attached, the hump 80 rising above the main portion 61 of the blade 60.

Figure 3:
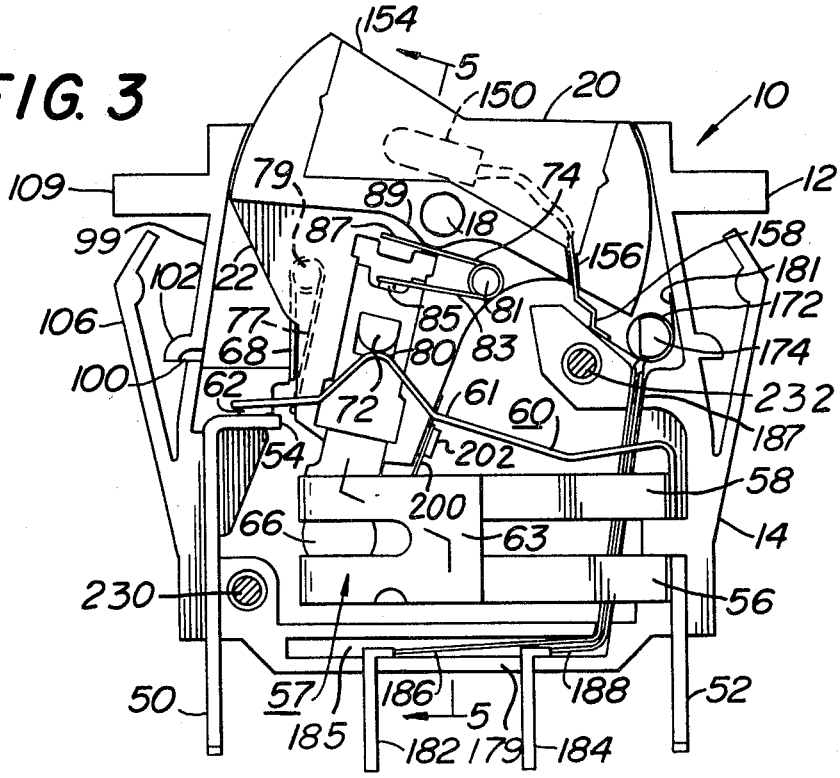
FIG. 3 is a side elevation similar to FIG. 2 but showing the contacts closed position.

The slidable latch 42 also includes a cam stop 72 which engages the movable contact blade 60, as shown, for biasing the movable contact 62 into engagement with the stationary contact 54 when the rocker 20 is in the position of FIG. 3, the contacts closed or "on" position. When the rocker 20 is manually moved to the contacts open or "off" position, shown in FIG. 2, the cam stop 72 slides off of the hump 80 and down to the right along toward the main portion 61 of the movable blade 60 so as to release the blade 60 and permit it to move upwardly.

The slidable latch 42 is normally prevented from moving upwardly under the bias of the contact blade 60 by a detent 70 pressed outwardly on the latch lever 40. The detent 70 engages a surface 71 defining part of the hole 73 formed when the cam stop 72 is pressed out of the slidable latch 42.

The lower portion of the latch lever 40 carries an insulator button 66. The button 66 minimizes the transfer of heat from the bimetal 57 to the latch lever 40 and thus forms a heat isolator. When the bimetal 57 is sufficiently heated on overload conditions, it bends toward the button 66 and the leftmost portions of the bimetal legs 56 and 58 press against the button 66. When the bimetal legs 56 and 58 press sufficiently against the button 66 the latch lever 40 is pivoted back, about the wall 29, away from the slidable latch 42. Such movement disengages the detent 70 (formed on the latch lever 40) from the surface 71 of the slidable latch 42, permitting the latch 42 to move upwardly under pressure of the movable contact blade 60 which presses against the raised cam stop 72, at which time the movable contact blade 60 moves upwardly due to its own spring resiliency, separating the movable contact 62 from the stationary contact 54.

In FIG. 5, the initial or contacts closed position of the latch lever 40 is shown in solid lines while the maximum pivoted position (to the right) is shown in dot-dash lines corresponding to the maximum bending of the heated bimetal 57.

Simultaneously, with the release of the slidable latch 42, the rocker 20 is pivoted counterclockwise to the "off" or contacts open position by a spring 77 which is coiled about a boss 79 (integral with the base 14 and projecting inwardly) and which has one leg 67 biased against the left side of the extension 22 of the rocker 20 and the other leg 68 biased against a boss 65 (FIG. 2) projecting from the base 14. To accommodate the boss 79, the extension 22 of the rocker 20 is provided with an arcuate recess 88, shown in FIG. 9. The slidable latch 42 is biased downwardly toward the movable contact blade 60 by a coil spring 74 carried by a boss 81 integral with the extension 22. The spring 74 has one leg 83 bearing against the tab 85 formed on the latch 42 and the other leg 87 bearing against ridge 89 of the rocker 20.

As the rocker rotates counterclockwise, the cam stop 72 is carried to the right sliding along the hump 80 toward the main portion 61 of the contact blade 60.

Figure 4:
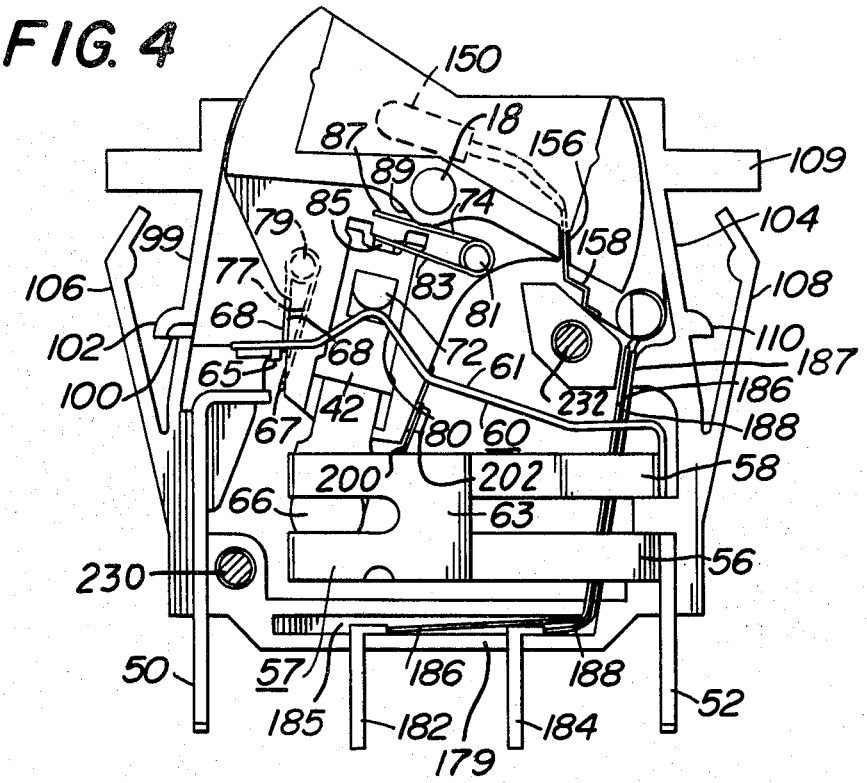
FIG. 4 is a side elevation similar to FIG. 3 but showing the trip free position, that is, the position when the rocker is manually held in the contacts closed position, but the bimetal has been heated (by an overload current) sufficiently to trip the slidable latch.

As long as the bimetal 57 remains sufficiently heated to bend sufficiently to disengage the detent 70 from the catch surface 71, it will be impossible to maintain the contacts 54 and 62 closed even if the rocker 20 is manually kept in the contacts closed position and this position is illustrated in FIG. 4, i.e., the trip free position.

When the bimetal 57 cools sufficiently to bend back to its initial position, the position of the bimetal 57 shown in FIGS. 3 and 5, the latch lever 40 will also pivot back to its initial position (the solid line position in FIG. 5) and the slidable latch 42 will be pushed down by the spring 74 until the detent 70 enters the hole 73 in the slidable latch 42 and relatches the two together by the detent 70 engaging the catch surface 71.

When the rocker 20 is manually pivoted counterclockwise, relative to FIG. 3, the cam stop 72 is moved to the right past the hump 80 of the movable contact blade 60 and down, relative to the hump 80, toward the main portion 61 of the blade 60. The movable blade 60, because of its spring resilience, moves up at such time separating the movable contact 62 from the stationary contact 54 to open the circuit to which the circuit protector 10 is connected, achieving the contacts open or "off" position shown in FIG. 2.

The left hand end wall 99 of the base 14 is provided with a vent opening 100 adjacent the stationary and movable contacts 54 and 62, respectively. The end wall 99 has a projecting hood 102 obstructing the opening 100 to minimize the possibility of inserting an object into the case 12 through the opening 100.

To mount the circuit protector 10 to a panel (not shown) the end wall 99 and the opposite end wall 104 are provided with integral flexible fingers 106 and 108, respectively, and a flange 109. A projection 110 is placed on the end wall 104, as shown. The projections 102 and 110 are about midway along the length of the fingers 106 and 108 and tend to prevent flexing of the fingers 106 and 108 to the point where they would snap off. The circuit protector 10 may be mounted through a hole in a suitable panel (not shown) by inserting the terminal end of the protector into a panel hole until the fingers 106 and 108 flex and snap behind the panel at which time the underside of the flange 109 abuts the panel.

The rocker 20 may be illuminated by providing a suitable lamp 150 within a cavity 152 (FIG. 10) formed in the rocker 20 and covered by a suitable plastic snap-on cap 154. Two channels 156 on opposite sides of the rocker 20 are provided for terminals 158 and 160, but only one of the channels is shown in FIGS. 2, 3 and 4. The terminals 158 and 160 are connected to leads 161 extending from the lamp 150 and the terminals 158 and 160 extend below the rocker 20, as shown.

Disposed below the terminals 158 and 160 and spaced therefrom, as shown in FIG. 2, are two coil springs 170 and 172 mounted on a post 174 projecting from and integral with the base 14. The coil springs 170 and 172 are spaced from each other by an insulating spacer 175, FIG. 10. The springs 170 and 172 have U-shaped legs 176 and 178 resting upon the sloping surface 180 formed integral with the base 14, as shown in FIGS. 2, 3, 4 and 10. The other legs 181 and 183 of the springs 170 and 172 are biased against the end wall 104, FIG. 2.

A projection 179 of the base 14 between the terminals 50 and 52 carries auxiliary terminals 182 and 184. The terminals 182 and 184 are connected to lead wires 186 and 188 which extend through a cavity 185 in the projection 179 and through a channel 187 to the coils 170 and 172. The upper ends of the leads 186 and 188 are stripped of insulation and are wedged into the coils of the springs 170 and 172, as shown.

Thus, in the position shown in FIG. 2, the terminals 158 and 160 are spaced from the legs 176 and 178 and the circuit to the lamp 150 is open. When the rocker 20 is moved to the position in FIG. 3, the terminals 158 and 160 engage the legs 176 and 178 closing the circuit to the lamp 150 and illuminating the latter, assuming that the terminals are connected to a suitable power source.

For calibrating the bimetal 57, an adjustable screw 220 is threaded through a suitable hole in the cover 16. The screw 220 engages the base 63 of the bimetal 57, as shown in FIG. 5.

Suitable rivets 230 and 232 extend through the base 14 and cover 16 to secure them together, as is well known.

FIG. 11 illustrates a modification of this invention. The latch lever 340 and the slidable latch 342 are provided with suitable holes 344 and 346, respectively, as shown. A coil spring 329 is secured to the latch lever 340 and slidable latch 342 by opposite ends which extend through holes 344 and 346 to tension the latch lever 340 and 342 toward each other. The spring 329 thus performs the function of the springs 74 and 200 in the previous embodiment.

What I claim is:

1. A circuit protector comprising a case, a rocker movable between "on" and "off" positions, a first spring means within said case for biasing said ROCKER to the "off" position, a stationary contact, a movable contact carried by a movable contact blade, said rocker including an extension, said extension carrying a pivotal latch lever and a slidable latch, said latch lever having a detent restraining movement of said slidable latch, a second spring means biasing said latch lever toward said slidable latch, said slidable latch including a cam stop engaging said movable contact blade to keep said contacts engaged, a bimetal engageable on predetermined heating with said latch lever to pivot said latch lever away from said slidable latch, whereupon said detent is moved out of engagement with said slidable latch permitting said slidable latch to move upwardly under pressure of said movable contact blade and permitting said handle to be pivoted by said spring to the contacts "off" position.

2. The combination of claim 1 wherein said extension forms a slot defined by an end wall and by spaced apart walls so that said slot is open at one end, one of said spaced apart walls forming an abutment for said slidable latch at the end opposite said end wall to limit downward movement of said slidable latch, said latch lever and said slidable latch being carried by said extension in said slot, said end wall and said spaced apart walls receiving said latch lever, and a third spring means biasing said slidable latch toward said movable contact blade.

3. The combination of claim 2 wherein said first spring means has one leg biased against said case and the other leg is biased against said rocker for biasing said rocker to the "off" position.

4. The combination of claim 1 wherein said second spring means comprises a a coil spring connected at one end to said latch lever and at the other to said slidable latch for simultaneously biasing said latch lever toward said slidable latch and said bimetal while also biasing said slidable latch toward said movable contact blade.

* * * * *